United States Patent [19]

Liotta

[11] 4,300,994

[45] Nov. 17, 1981

Best Available Copy

[54] METHOD FOR PRODUCING COKE

[75] Inventor: Ronald Liotta, Clark, N.J.

[73] Assignee: Exxon Research & Engineering Co., Florham Park, N.J.

[21] Appl. No.: 164,170

[22] Filed: Jun. 30, 1980

[51] Int. Cl.[3] ..... C10G 1/00; C10B 57/04

[52] U.S. Cl. ..... 208/8 LE; 208/46; 201/20

[58] Field of Search ..... 208/8 LE, 46; 201/20

[56] References Cited

U.S. PATENT DOCUMENTS

| | | | |
|---|---|---|---|
| 2,378,762 | 6/1945 | Frey | 208/46 |
| 3,330,757 | 7/1967 | Richard | 208/11 LE |
| 3,359,197 | 12/1967 | Moscrontonio et al. | 208/14 |
| 3,376,212 | 4/1968 | Moscrontonio et al. | 208/2 |
| 3,992,432 | 11/1976 | Napier et al. | 260/465.1 |
| 3,998,604 | 12/1979 | Hinkley | 44/1 R |
| 4,059,410 | 11/1977 | Schlosberg et al. | 44/1 R |
| 4,072,475 | 2/1978 | Schlosberg et al. | 44/1 R |
| 4,089,772 | 5/1978 | Gorbaty et al. | 208/8 LE |
| 4,092,235 | 5/1978 | Schlosberg et al. | 208/8 LE |
| 4,121,910 | 10/1978 | Stambaugh | 44/1 B |

FOREIGN PATENT DOCUMENTS 851191 5/1977 Belgium .

OTHER PUBLICATIONS

"Bradstrom" et al., vol. 23, Acta. Chem. Scand., p. 2202, (1969).
"Wagenknecht" et al., vol. 2, Synthetic Communications, pp. 215–219, 1972.
"McKillop et al., vol. 30 Tetrahedron, pp. 1379–1382, (1974).
"Bashall" et al., Tetrahedron Letters, pp. 3489–3490, (1975).
"Eckhard" et al., Tetrahedron Letters, pp. 95–96, (1976), German Off, DT-2634419.
"Blom" et al., vol. 36, Fuel, pp. 135–153, (1957).
"Yohe" et al., vol. 69, Journal of Amer. Chem. Soc., pp. 2644–2648, 1947.
"Sternberg" et al., vol. 53, Fuel, pp. 172–175, (1974).
"Heathcoat" et al., J. of the Chem. Society, pp. 2839ff, (1932).
"Kroger" et al., vol. 18, Erdöl und Kohle Erdgas Petrochemie, pp. 368–372, (1965).
Sokolova et al., vol. 1, Trudy Inst. Nefti, Akad. Nauk SSSR, pp. 277–284, (1950).
"Fugassi" et al., Am. Chem. Soc. Div. of Gas Fuel Chem., Preprints, pp. 125–131, (1958).
Hodek et al, vol. 52, Fuel, pp. 220–225, (1973).
"Olleman", vol. 24, Anyl. Chem., pp. 1425–1439, (1952).
"Lahiri" et al., vol. 36, Fuel, pp. 254–256, (1957), vol. 20, J. of Indian Chem. Soc., Ind. and News Ed., pp. 91–94, 1957.
Zabavin", Bulletin of Academy of Science, Tech., No. 8, USSR, pp. 35–49, 1943.
"Danetskaya", Gigiena i Sanit, pp. 26–31, (1952).

*Primary Examiner*—Delbert E. Gantz
*Assistant Examiner*—William G. Wright
*Attorney, Agent, or Firm*—Henry E. Naylor

[57] ABSTRACT

Disclosed is a method for improving the caking properties of coals by use of quaternary base solutions. Caking properties of various coals can be upgraded for the production of metallurgical grade coke, preferably with a substantially reduced mineral matter content.

37 Claims, No Drawings

METHOD FOR PRODUCING COKE

BACKGROUND OF THE INVENTION

The present invention relates to the production of coke preferably for metallurgical use by way of oxygen-alkylation of coal.

In general, the better the caking properties of coal, the more suitable it is for metallurgical coke formation. For various reasons, coals characterized by moderately, weakly and non-caking qualities are used in metallurgical coke formation after their caking properties have been improved. Caking properties of such coals are usually improved by physically mixing or blending them with a binder material prior to pyrolysis. This binder material helps to agglomerate the coal into a molten plastic or liquid state when it is heated to pyrolysis temperatures. Subsequently, when the coke is cooled, a coherent solid is formed characterized by an isotropic appearance and a hardness which is suitable for metallurgical purposes. Examples of binders which have been employed for increasing the caking properties of coal include coal-derived and petroleum-derived carbonaceous materials such as coal extracts, tar, pitch, tar oil, fuel oil, asphalt, crude petroleum extracts, bitumen, and the like. However, the use of such binders may not be economically attractive because relatively large amounts of such binder material are usually required in order to significantly increase the caking properties of a moderately weakly or non-caking coal.

Furthermore, coal liquids and gases derived from pyrolysis of coal generally evidence undesirable properties. For example, coal liquids are generally found to be relatively unstable and have a tendency to polymerize in a matter of days; thereby forming highly viscous liquids and eventually solid tars. Coal gases usually evidence relatively low heat values.

SUMMARY OF THE INVENTION

In accordance with the present invention, there is provided a method for preparing coke having improved quality. The method comprises: (a) treating coal with a quaternary base solution, and (b) pyrolyzing the treated coal to a temperature from about 250° C. to about 1000° C. for a time sufficient to complete pyrolysis thereby converting substantially all the coal to coke.

The quaternary base solution is one containing one or more quaternary ammonium bases represented by the formula $R_4MOR'$ where each R is the same or different group selected from the $C_1$ to about $C_{20}$ alkyl, aryl, arylalkyl, alkylaryl, ether, ester, sulfide, and amine, as well as silicon, selenium, or a metal selected from Groups IA and IIA of the Periodic Table of the Elements, as long as at least one R is a $C_1$ to $C_4$ alkyl group. M is selected from Group VA of the Periodic Table of the Elements, and R is hydrogen or a $C_1$ to about $C_{20}$ alkyl, aryl, arylalkyl or alkylaryl group.

In a preferred embodiment of the present invention mineral matter is removed from the coal before the coal is pyrolyzed to coke. This is accomplished by (1) first contacting the coal with the quaternary base, (2) separating mineral matter from coal, and (3) pyrolyzing the remaining coal at a temperature from about 250° C. to about 1000° C., for an effective amount of time to complete the pyrolysis.

In another preferred embodiment of the present invention the coal is demineralized, oxygen-alkylated, then pyrolyzed to form coke.

DETAILED DESCRIPTION OF THE INVENTION

Generally the formation of coke, especially coke suitable for use in the metallurgical industry, requires a coal, having good caking properties, as a starting material. The caking coal is pyrolyzed and an acceptable coke is formed. By the practice of the present invention, the caking property of coal can be improved. Coals normally not suitable for coke production, because of their non-caking or weakly caking properties, can now be employed for such purposes after treatment according to the present invention. For example, the caking properties of weakly and moderately caking coals can be improved so that they will be suitable for the production of metallurgical grade coke. The caking properties of some non-caking coals can even be improved to such a degree that they will also produce metallurgical grade coke upon pyrolysis. Of course, those non-caking coals that evidence only improved caking properties just short of metallurgical grade can be further upgraded by any conventional method used in the art for improving the caking properties of coal.

The present invention is particularly beneficial for preparing a coke having a reduced mineral matter content especially a reduction in pyrite. Pyrite can be a problem in metallurgical coke because of its abundance as well as its high sulfur content. Further, the mineral matter contained in the coke will be found to be more homogeneously dispersed thereby improving the hardness of the coke. The removal of mineral matter can also contribute to improving the hardness of the coke. Coke having good hardness quality is particularly suitable for metallurgical purposes because it must support a substantial amount of iron ore.

Caking properties of coal are important for the conversion of coal to coke. That is, the coal must first go through a softening or plastic state during heating before it solidifies to form a compact mass. Non-caking coals will generally not soften upon heating; but will fragment and expel gaseous materials. At the end of the heating cycle non-caking coals will be in powder form, as opposed to a caked form. Caking properties of all coals are improved by the practice of the present invention. For example, subbituminous coals, which are generally non-caking by nature, can become caking after treatment by the present invention. Further, coal liquid and gas pyrolysates manifest improved properties, such as stability and compatibility with petroleum products, as compared with untreaed coals. Further, coal gas obtained upon pyrolysis of coals treated according to the present invention are richer in hydrogen content and therefore exhibit higher heat values than untreated coals.

The method of the present invention for increasing the caking property of coals, differs from methods of the prior art in that a deliberate chemical transformation takes place on the coal when treated according to the present invention. Prior art methods generally teach physically blending the coal with a binder material. In the practice of the present invention, the available acidic functionalities, such as phenolic and carboxylic functionality, of the coal are chemically altered. These two very polar funtional groups are converted to relatively non-polar ethers and esters, respectively. The O-alkylation of the present invention is not the same as carbon (C) alkylation as disclosed in U.S. Pat. No. 4,092,235 which discloses a Friedel-Crafts type alkylation which adds an alkyl group to protonated aromatic carbons and deteriorates the caking properties of coals.

Although not wishing to be limited by theory, it is believed that the chemical transformation for a one-stage heating process according to the present invention, can be represented by the following:

$$\text{coal} - \text{OH} + \text{R}_4\text{MOR}' \xrightarrow{25^\circ\text{ C.}} \text{Coal} - \text{O}^-\text{N}^+\text{R}_4 + \text{HOR}' \quad (1)$$

$$\text{coal} - \text{O}^-\text{N}^+\text{R}_4 \xrightarrow[1000^\circ\text{ C.}]{250^\circ\text{ C.}} \text{Coke} - \text{R} + \text{liquids} - \text{R} + \text{gas} - \text{R} + \text{NR}_3 \quad (2)$$

wherein coal—OH represents a coal molecule, or a portion thereof, having attached thereto the weakly acidic proton hydrogen; and where each R is the same or different group selected from the $C_1$ to about $C_{20}$ alkyl, aryl, acyl, arylalkyl, alkylaryl, ethers, ester, as well as sulfide, amine, and atoms of silicon, selenium, or a metal selected from Groups IA and IIA of the Periodic Table of the Elements, as long as at least one R is a $C_1$ to $C_4$ alkyl group. Preferably R is a $C_1$ to $C_{20}$ alkyl, aryl, acyl, arylalkyl or alkylaryl; more preferably R is a $C_1$ to $C_6$ alkyl or aryl group and most preferably R is a $C_1$ to $C_4$ alkyl group. M is selected from Group VA of the Periodic Table of the Elements, preferably nitrogen or phosphorus, more preferably nitrogen. R' is hydrogen, a $C_1$ to about $C_{20}$; preferably a $C_1$ to $C_{10}$ alkyl, aryl, arylalkyl or alkylaryl; more preferably R' is hydrogen or a $C_1$ to $C_4$ alkyl group; most preferably R' is hydrogen. By Periodic Table of the Elements we mean that table of the chemical elements which is represented on the inside covers of the Handbook of Chemistry and Physics, 55th Edition, by CRC Press.

In reaction (1), depicted above, coal is contacted, preferably at room temperature (25° C.) with a solution containing the quaternary base for an effective amount of time. By effective amount of time, we mean at least enough time to effect substantially complete reaction of the quaternary base with the acidic protons of the coal. Generally this time is from about 5 to 100 minutes at room temperature (25° C.). Although room temperature is preferred, the reaction can proceed from about room temperature to the boiling point of the reagents employed. Increased temperature will, of course, increase the reaction rate. Further, the reaction is conveniently carried out at atmospheric pressure, although low to moderate pressures (about 1 to 20 atmospheres) may be employed. It is preferred that mineral matter be separated from the treated coal after reaction (1) above.

When mineral matter is first removed from the coal before coke formation by contacting the coal with the quaternary base solution, chemical comminution of the coal takes place. This comminution or breaking-up of the coal facilitates the separation of the inorganic fraction and the organic fraction of the coal. The organic fraction evidences a reduction in density owing to its reaction with the quaternary base. Therefore, the relative differences of density between the organic fraction and the inorganic fraction enables a majority of both fractions to be separated from each other by conventional physical separation techniques.

Conventional physical separation techniques suitable for use herein include any of those techniques based on the density differences of the materials to be separated. Non-limiting examples of such techniques include sink-floatation, froth-floatation and centrifugation. Preferred is the sink-floatation method wherein the solvent employed has a density less than the inorganic component but greater than the organic component. By selecting such a solvent, the inorganic component will sink and the organic component will float, thereby effecting the separation of the two. If such a solvent is not chosen, that is, if both the inorganics and organics sink or float in the solvent, then separation may be accomplished by centrifugation.

It is generally believed that major inorganic constituents in coal include those of silicon, aluminum, iron, calcium, magnesium, sodium, potassium, manganese, sulfur and phosphorus. For example, silicon is usually found in the form of silicates of such elements as calcium, magnesium, etc. Iron is usually found, to a major extent, as pyrite ($FeS_2$), which is generally considered the most undesirable impurity because of its abundance, as well as its high sulfur content. By the practice of this invention a relatively high percentage (about 75 wt.%) of pyrite was removed by using a stoichiometric amount of quaternary base, such as tetrabutylammonium hydroxide, to acidic protons on No. 6 bituminous coal.

Non-limiting examples of preferred quaternary bases suitable for use herein include tetramethylammonium hydroxide and alkoxide, tetraethylammonium hydroxide and alkoxide, tetrapropylammonium hydroxide and alkoxide, tetrabutylammonium hydroxide and alkoxide, tetrapentylammonium hydroxide and alkoxide, tetrahexylammonium hydroxide and alkoxide, benzylhexadecyldimethyl ammonium hydroxide and alkoxide, tetraethylphosphonium hydroxide and alkoxide, tetrapropylphosphonium hydroxide and alkoxide tetrabutylphosphonium hydroxide and alkoxide, tetrapentylphosphonium hydroxide and alkoxide, tetrahexylphosphonium hydroxide and alkoxide, and benzylhexadecyldimethylphosphonium hydroxide and alkoxide. Preferred are the ammonium hydroxide and $C_1$ to $C_4$ alkoxides, more preferred are the ammonium hydroxide, and most preferred is tetramethylammonium hydroxide.

The quaternary base as used herein is in solution form and can be prepared by dissolving the corresponding quaternary salt in a solvent selected to give the desired base. Non-limiting examples of such solvents suitable for use herein include water, $C_1$ to $C_{20}$ aliphatic alcohols, phenol, etc. For example, if the desired base of a particular quaternary salt is the corresponding hydroxide, then the quaternary salt is dissolved in water. Furthermore, if the desired base is a methoxide, then methanol is used as the solvent. In other words, the complementary alcohol to the alkoxide etc. is used to dissolve the quaternary salt. It will be noted that only a stoichiometric amount of solvent is needed to convert the quaternary salt to the corresponding base; preferably an excess amount of such solvent is employed so that in actuality it functions as a solvent.

It is also within the scope of this invention to use a co-solvent, which may act to increase the reaction rate. Non-limiting examples of co-solvents suitable for use herein include tetrahydrofuran, benzene, toluene, cyclohexane, etc.

It is preferred that a stoichiometric amount of quaternary base be employed relative to the nunber of available acidic protons of the coal. Of course, the actual amount of quaternary base employed will be dependent on the economics of the particular process and the coal employed.

The present invention can be practiced in a variety of ways. Broadly speaking, the coal is first brought into contact with the quaternary base solution; then the entire solution containing the contacted coal is subjected to pyrolysis temperatures of from about 250° C. to about 1000° C. Preferably, mineral matter is removed from the treated coal prior to pyrolysis, thereby effecting a metallurgical grade coke having a substantially reduced mineral matter content. It is also within the scope of this invention to first oxygen-alkylate the coal before pyrolysis by first heating the treated coal to temperatures of from about 100° C. to about 250° C. If the treated coal undergoes a demineralization as well as O-alkylation, then the coal is subject to oxygen-alkylation temperatures after the demineralization procedure.

In all of the above-described process variations, a tri-substituted Group VA compound by-product will result from any of the heating stages. This tri-substituted Group VA compound by-product can be used to regenerate a quaternary base by conventional techniques and the base can be recycled to the coal feed. One technique which can be used is alkylating the tri-substituted Group VA compound with an alkylating agent to form the quaternary salt $R_4M^+X^-$. This salt can then be converted to the corresponding quaternary hydroxide by treatment with silver oxide. Other conventional techniques include electrolysis or an ion-exchange method in which the quaternary salt solution is passed through an ion-exchange column filled with a highly basic anion-exchange resin, preferably in —OH form. Such resins are generally known in the art and the selection of any particular resin, as well as the reaction conditions, can be determined by routine experimentation of one having ordinary skill in the art.

Alkylating agents suitable for use in regenerating the quaternary base are those represented by the formula RX where R is one or more $C_1$ to $C_{20}$ alkyl groups and X is a leaving group selected from the group consisting of halide, sulfate, bisulfite, acetate, and stearate, wherein X is attached to a primary or secondary carbon atom. When the alkylating agent is a halide, the halide is selected from the group consisting of chlorine, bromine and iodine. More preferred is when the alkylating agent is a methyl halide or dimethyl sulfate, most preferred is dimethyl sulfate.

Demineralization is more fully described in U.S. Ser. No. 164,240 and O-alkylation is more fully described in U.S. Ser. No. 164,239 both applications being related to and filed on the same day with the present application and both being incorporated herein by reference.

Although chemical comminution of the coal occurs when it is contacted with the quaternary base solution, it may still be desirable to reduce the coal to a relatively finely ground state before processing. If so, the coal can be physically ground by conventional means so that it is comprised of a majority of particles less than about ¼ inch in size, preferably less than about 8 mesh (U.S. Sieve Size), more preferably less than about 80 mesh. Smaller sizes are preferred because the smaller the size of the coal particles, the greater their surface area will be, thereby contributing to faster reaction rates. Therefore, it is desirable to expose as much of the surface of the coal to quaternary base as possible without losing coal as fines or as the economics of coal grinding may dictate. Whether or not to grind and to what sizes to grind can be easily determined by one skilled in the art for any given coal, reaction scheme, reaction conditions, etc.

It is also within the scope of this invention to treat the coal with a solvent either before or after O-alkylation. Preferred is when the coal is treated with a solvent before O-alkylation; that is, before the coal is contacted with the quaternary ammonium base. In doing so, coal solubles are removed before alkylation and can be used as a source of fuel to run the instant processes or can be marketed separately. Furthermore, less coal would be left for alkylation without adversely affecting the yield of coke for a given amount of unprocessed coal.

Generally, the caking properties of any type coal can be improved by the practice of this invention. Non-limiting examples of such coals include anthracite, bituminous, subbituminous lignite as well as other solid carbonaceous materials of natural origin which contain acidic functionality. When the coal, after treatment herein, is intended to be used for metallurgical purposes, coals such as anthracite, bituminous, and subbituminous coals must be employed.

In the pyrolysis of coal, there are always produced coal liquids and gases. After pyrolysis of the O-alkylation coals of the present invention, the pyrolysis products, as well as the chemical composition of the resultant coal liquids and gases, are changed. For example, a higher hydrogen to carbon ratio is found for the coal liquids and gases which are produced from the pyrolysis of a coal treated in accordance with the invention, as compared to the corresponding untreated coal. As is wellknown, a higher H/C ratio renders these liquids and gases more valuable. Further, the coal products following pyrolysis evidence improved stability and compatibility with petroleum products.

Pyrolysis of alkylated bituminous coal produces greatly improved caking properties in coal which was only moderately caking before the process of this invention was used. O-alkylation of subbituminous coal that is originally a non-caking coal generates an agglomerated coke upon pyrolysis.

The following examples serve to more fully described the manner of practicing the above-described invention, as well as to set forth the best modes contemplated for carrying out various aspects of the invention. It is understood that these examples in no way serve to limit the true scope of this invention, but rather are presented for illustrative purposes.

EXAMPLE 1

1 g. of Illinois No. 6 coal was agitated at room temperature (25° C.) with 4 mmoles of tetrahexylammonium hydroxide in methanol. The methanol was evaporated off and the treated coal was heated in a nitrogen atmosphere to a temperature of 600° C. and held at that temperature for 10 minutes.

EXAMPLE 2

1 g. of Illinois No. 6 coal was agitated at room temperature with 4 mmoles of tetrabutylammonium hydroxide in methanol. The methanol was evaporated off and the treated coal was heated in a nitrogen atmosphere to a temperature of 600° C. and held at that temperature for 10 minutes.

The coke resulting from Examples 1 and 2 above were compared to coke prepared from Illinois No. 6 coal which was not treated, before pyrolysis, according to the present invention. It was found that the cokes from both Example 1 and 2 above evidenced a significant improvement in cake properties, (i.e., greater strength) when compared to the coke from untreated coal.

The coke resulting from Examples 1 and 2 above were also compared to the coke formed as a result of the O-alkylation method taught in U.S. application Ser. No. 69,019, filed Aug. 23, 1979 and incorporated herein by reference. It was found that the cokes resulting from the method claimed herein were substantially equivalent to the cokes resulting from the O-alkylation of Ser. No. 69,059 filed Aug. 23, 1979, now U.S. Pat. No. 4,259,167, for any given quaternary base employed. For example, the coke of Example 2 above underwent O-butylation during heating to pyrolysis temperature and compared in color and strength with O-butylated coal of Example 36 in Ser. No. 69,059, filed Aug. 23, 1979 now U.S. Pat. No. 4,259,167.

EXAMPLE 3

1 g. of Rawhide subbituminous coal was agitated at room temperature with 6.8 mmoles of tetrahexylammonium hydroxide in methanol. The methanol was evaporated off and the treated coal was heated, in a nitrogen atmosphere, to a temperature of 600° C. and held at that temperature for 10 minutes.

EXAMPLE 4

1 g. of Rawhide subbituminous coal was agitated at room temperature with 6.8 mmoles of tetrabutylammonium hydroxide. The treated coal was heated, in a nitrogen atmosphere, to a temperature of 600° C. and held at that temperature for 10 minutes.

The coke resulting from these Examples 3 and 4 were compared with untreated Rawhide coal which was also heated, in a nitrogen atmosphere, to 600° C. and held at that temperature for 10 minutes. The untreated Rawhide coal after pyrolysis was not caked but was a free flowing powder. The cokes of Examples 3 and 4 herein were caked and were observed to be substantially equivalent to the cokes formed by way of O-alkylation of Rawhide subbituminous coal, which are illustrated in Example 36 of Ser. No. 69,059 filed Aug. 23, 1979, now U.S. Pat. No. 4,259,167.

EXAMPLE 5

10 g. of Illinois No. 6 bituminous coal was mixed with about 46 ml 1 molar solution of tetrabutylammonium hydroxide in water, at 25° C. and one atmosphere pressure. This amount of tetrabutylammonium hydroxide represented about a stoichiometric amount of hydroxide based on the available acidic proton content of the coal. The mixture was centrifuged for four hours at about 2,400 rpm. The sample was examined after centrifugation and the bottom layer of solids was found to be (by X-ray analysis) substantially all pyrite. The organic layer located above the more dense inorganic layers was removed and neutralized with dilute HCl to restore the original covalent structure of the coal. By control experiments it was found that the HCl treatment had little effect on the mineral matter content of the sample.

The overall inorganic content of the coal was found to be reduced by about 50 wt. %, based on the total inorganics originally present. Table I below shows the removal of the major inorganic components in the coal; pyrite, silicon silicate, silica, and sodium compositions.

TABLE I

Elemental Composition of Illinois No. 6 Coal Before and After Treatment

| Inorganic Component | wt. % Before | wt. % After | % Removal |
|---|---|---|---|
| Pyrite | 3.4 | 0.84 | 75.3 |
| Silicon | 3.0 | 1.8 | 40 |
| Aluminum | 1.0 | 0.75 | 25 |
| Sodium | 0.55 | 0.0 | 100 |

Upon pyrolysis, it is believed that the treated coal of this example will produce a coke of exceptional quality. That is a coke which will have relatively high strength properties wherein the remaining mineral matter will be found to be substantially homogeneously dispersed throughout the coke.

EXAMPLE 6

The procedure of the above Example 5 was followed except tetrabutylammonium methoxide in methanol was employed. It was found that 28 wt. % of the coal dissolved in the basic methanol solution. That is 28 wt. % of the coal was completely demineralized when dissolved because none of the mineral matter was found to be dissolved in the methanol solution. Centrifugation of the remaining 72 wt. % of the sample produced results similar to those reported in Example 1 above. That is, about a 50 wt. % in mineral matter content of the remaining 72 wt. % of the sample (adjusted for the removal of the 28 wt. % based on the total weight of the sample) organic component.

EXAMPLE 7

The procedure of Example 5 above was followed except tetraethylammonium hydroxide was used as the quaternary base. It was found that about 40 wt. % of the mineral matter (based on the total amount of mineral matter present in the sample) was separated.

Upon pyrolysis, it is believed that the resulting coke will also have relatively high strength properties and have the remaining mineral matter substantially homogeneously dispersed throughout the coke.

What is claimed is:

1. A method for improving the caking properties of coal or peat, which method comprises:
   (a) treating the coal with a quaternary base solution, and
   (b) by pyrolysing the treated coal at a temperature from about 400° C. to about 600° C.,
   wherein the quaternary base solution contains at least one quaternary base represented by the formula:

$$R_4MOR'$$

where each R is the same or different group selected from the $C_1$ to $C_{20}$ alkyl, aryl, acyl, arylalkyl, alkylaryl, ether, ester, as well as, sulfide, amine, heteroatoms of silicon, selenium or a metal selected from Groups IA and IIA of the Periodic Table of the Elements, M is selected from Group VA of the Periodic Table of the Elements, and R' is hydrogen or a $C_1$ to $C_{20}$ alkyl, aryl, arylalkyl or alkylaryl group.

2. The method of claim 1 wherein each R is the same or different $C_1$ to $C_6$ alkyl or aryl group.

3. The method of claim 2 wherein each R is the same or different $C_1$ to $C_4$ alkyl group.

4. The method of claim 1 wherein M is selected from the group consisting of nitrogen and phosphorus.

5. The method of claim 3 wherein M is selected from the group consisting of nitrogen and phosphorus.

6. The method of claim 1 wherein R′ is hydrogen or a $C_1$ to $C_4$ alkyl group.

7. The method of claim 6 wherein R′ is hydrogen.

8. The method of claim 5 wherein R′ is hydrogen.

9. The method of claim 1 wherein the quaternary base is regenerated and recycled from the trisubstituted Group VA compound which is a by-product of the instantly claimed method.

10. The method of claim 7 wherein the quaternary base is regenerated and recycled from the trisubstituted Group VA compound which is a by-product of the instantly claimed method.

11. The method of claim 1 wherein the coal is a non-caking subbituminous coal.

12. The method of claim 1 wherein the coal is a weakly or moderately caking bituminous coal.

13. The method of claim 1 wherein prior to pyrolysis, the coal is treated with an organic solvent to extract soluble coal.

14. The method of claim 1 wherein at least a stoichiometric amount of quaternary base is employed based on the total number of acidic sites on the coal.

15. The method of claim 10 wherein at least a stoichiometric amount of quaternary base is employed based on the total number of acidic sites on the coal.

16. A method for producing a coke having improved cake properties and having a substantially reduced level of mineral matter content, the method which comprises:

(a) treating a coal or peat with a solution containing at least one or more quaternary bases;

(b) physically separating mineral matter from the solution containing the treated coal; and (c) pyrolyzing the treated coal at a temperature from wherein the quaternary base solution contains at least one quaternary base represented by the formula:

$R_4MOR'$ where each R is the same or different group selected from the $C_1$ to $C_{20}$ alkyl, aryl, acyl, arylalkyl, alkylaryl, ether, ester, as well as, sulfide, amine, heteroatoms of silicon, selenium or a metal selected from Groups IA and IIA of the Periodic Table of the Elements, M is selected from Group VA of the Periodic Table of the Elements, and R′ is hydrogen or a $C_1$ to $C_{20}$ alkyl, aryl, arylalkyl or alkylaryl group.

17. The method of claim 16 wherein each R is the same or different $C_1$ to $C_6$ alkyl or aryl group.

18. The method of claim 17 wherein each R is the same or different $C_1$ to $C_4$ alkyl group.

19. The method of claim 16 wherein M is selected from the group consisting of nitrogen and phosphorus.

20. The method of claim 18 wherein M is selected from the group consisting of nitrogen and phosphorus.

21. The method of claim 16 wherein R′ is hydrogen or a $C_1$ to $C_4$ alkyl group.

22. The method of claim 21 wherein R′ is hydrogen.

23. The method of claim 20 wherein R′ is hydrogen.

24. The method of claim 16 wherein the mineral matter is separated from the organic portion of the coal or peat by a technique selected from the group consisting of sink-floatation, froath-floatation and centrifugation.

25. The method of claim 23 wherein the mineral matter is separated from the organic portion of the coal or peat by sink-floatation.

26. The method of claim 16 wherein the temperature at which the coal is contacted with the quaternary base is about 0° to about 100° C.

27. The method of claim 25 wherein the coal or peat is contacted with the quaternary base at a temperature from about 0° to 100° C.

28. The method of claim 16 in which steps (a) and (b) are repeated at least one more time to effect the removal of additional amounts of mineral matter from the coal.

29. The method of claim 27 in which steps (a) and (b) are repeated at least one more time to effect the removal of additional amounts of mineral matter from the coal.

30. The method of claim 16 wherein a stoichiometric amount of quaternary base is employed based on the amount of available acidic proton content of the coal or peat.

31. The method of claim 29 wherein a stoichiometric amount of quaternary base is employed based on the amount of available acidic proton content of the coal or peat.

32. The method of claim 16 wherein the coal is a non-caking subbituminous coal.

33. The method of claim 16 wherein the coal is a weakly or moderately caking bituminous coal.

34. The method of claim 16 wherein prior to pyrolysis, the coal is treated with an organic solvent to extract soluble coal.

35. The method of claim 31 wherein prior to pyrolysis, the coal is treated with an organic solvent to extract soluble coal.

36. The method of claim 16 wherein the quaternary base is regenerated and recycled from the trisubstituted Group VA compound which is a by-product of the instantly claimed method.

37. The method of claim 35 wherein the quaternary base is regenerated and recycled from the trisubstituted Group VA compound which is a by-product of the instantly claimed method.

* * * * *